US011655083B2

(12) United States Patent
Peng et al.

(10) Patent No.: US 11,655,083 B2
(45) Date of Patent: May 23, 2023

(54) CUP LID WITH LOCKING AND DELAYED RELEASE

(71) Applicant: Photo U.S.A. Corporation, Fremont, CA (US)

(72) Inventors: James P. Peng, Fremont, CA (US); Steven Peng, Fremont, CA (US)

(73) Assignee: Photo U.S.A. Corporation, Fremont, CA (US)

( * ) Notice: Subject to any disclaimer, the term of this patent is extended or adjusted under 35 U.S.C. 154(b) by 48 days.

(21) Appl. No.: 17/095,651

(22) Filed: Nov. 11, 2020

(65) Prior Publication Data

US 2022/0135294 A1 May 5, 2022

(30) Foreign Application Priority Data

Nov. 2, 2020 (CN) ..... 202022488459.4

(51) Int. Cl.
*B65D 51/18* (2006.01)

(52) U.S. Cl.
CPC ..... *B65D 51/18* (2013.01); *B65D 2251/0021* (2013.01); *B65D 2251/0087* (2013.01); *B65D 2251/1058* (2013.01)

(58) Field of Classification Search
CPC ..... B65D 51/18; B65D 2251/0021; B65D 2251/0087; B65D 2251/1058; B65D 43/164; B65D 5/66; B65D 5/64; B65D 47/08; B65D 47/0804; B65D 47/0828; B65D 2251/0081; B65D 43/26; B65D 2543/00046; B65D 2251/0028; B65D 2251/009; B65D 43/02; B65D 2251/0018; B65D 55/02; A47G 19/2272; A47G 3/18
See application file for complete search history.

(56) References Cited

U.S. PATENT DOCUMENTS

| | | | |
|---|---|---|---|
| D490,266 | S | 5/2004 | Imai |
| 6,994,268 | B2 | 2/2006 | Maruyama et al. |
| D521,795 | S | 5/2006 | Imai |

(Continued)

FOREIGN PATENT DOCUMENTS

| | | | | |
|---|---|---|---|---|
| CN | 107539609 A | * | 1/2018 | ..... E05B 15/04 |
| JP | 2006141799 A | | 6/2006 | |
| JP | 2015231852 A | * | 12/2015 | |

OTHER PUBLICATIONS

Zojirushi Stainless Mug Model SM-TAE Instruction Manual; Downloaded from https://www.zojirushi.com/support/manuals_stainlessbottles.html [accessed Feb. 16, 2021].

(Continued)

*Primary Examiner* — John K Fristoe, Jr.
*Assistant Examiner* — Laura E. Parker
(74) *Attorney, Agent, or Firm* — Stetina Brunda Garred & Brucker

(57) ABSTRACT

A cup lid with locking and delayed release includes a lid and a lid base coupled to the cup. The lid is hindgedly attached to the lid base, with a locking and release assembly with a selectively locking and unlocking button that is linked to a rocker latch defined by an inner locking hook and an outer locking hook. The lid includes a catch inner hook engageable to the inner locking hook on the rocker latch, and a catch outer look engageable to the outer locking hook on the rocker latch.

19 Claims, 5 Drawing Sheets

(56) References Cited

U.S. PATENT DOCUMENTS

| | | | |
|---|---|---|---|
| D522,794 | S | 6/2006 | Imai |
| D531,444 | S | 11/2006 | Ohashi |
| 7,284,674 | B2 | 10/2007 | Ueda et al. |
| D587,957 | S | 3/2009 | Imai |
| D588,411 | S | 3/2009 | Watanabe |
| D607,698 | S | 1/2010 | Tsukida |
| 7,797,807 | B2 | 9/2010 | Ueda et al. |
| D628,857 | S | 12/2010 | Tatsukawa |
| D641,591 | S | 7/2011 | Tsukida |
| D651,050 | S | 12/2011 | Goshi |
| D655,580 | S | 3/2012 | Kotani |
| D655,581 | S | 3/2012 | Kotani |
| D668,503 | S | 10/2012 | Kotani |
| D697,802 | S | 1/2014 | Lane |
| D698,593 | S | 2/2014 | Ishikawa |
| D698,594 | S | 2/2014 | Ishikawa |
| D709,734 | S | 7/2014 | Kotani |
| D710,155 | S | 8/2014 | Tatsukawa |
| D729,581 | S | 5/2015 | Boroski |
| D739,183 | S | 9/2015 | Lane |
| D744,290 | S | 12/2015 | Endo |
| D769,079 | S | 10/2016 | Kotani |
| D773,255 | S | 12/2016 | Horimoto |
| D787,262 | S | 5/2017 | Horimoto |
| D799,963 | S | 10/2017 | Akiyama |
| D842,645 | S | 3/2019 | Horimoto et al. |
| D848,787 | S | 5/2019 | Tatsukawa et al. |
| D865,457 | S | 11/2019 | Kotani |
| D876,173 | S | 2/2020 | Kotani |
| D892,537 | S | 8/2020 | Watanabe et al. |
| 2004/0089580 | A1 | 5/2004 | Ueda et al. |
| 2006/0043115 | A1 | 3/2006 | Tanaka et al. |
| 2006/0144873 | A1 | 7/2006 | Ohashi et al. |
| 2009/0114335 | A1 | 5/2009 | Ueda et al. |
| 2014/0175042 | A1* | 6/2014 | Lane ..... B65D 43/26 215/229 |
| 2015/0282654 | A1 | 10/2015 | Kurabe et al. |
| 2019/0364911 | A1 | 12/2019 | Yano et al. |
| 2020/0189812 | A1* | 6/2020 | Hice ..... B65D 43/164 |

OTHER PUBLICATIONS

Zojirushi Stainless Mug Model SM-QHE Instruction Manual; Downloaded from https://www.zojirushi.com/support/manuals_stainlessbottles.html [accessed Feb. 16, 2021].

* cited by examiner

FIG. 2
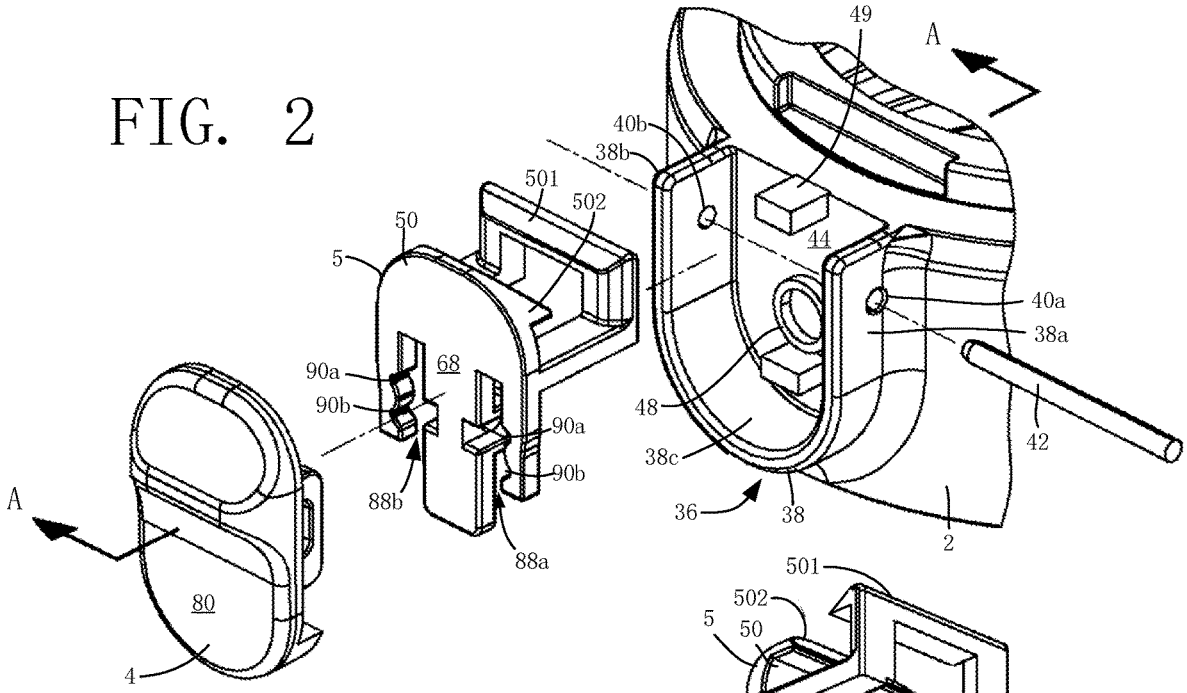
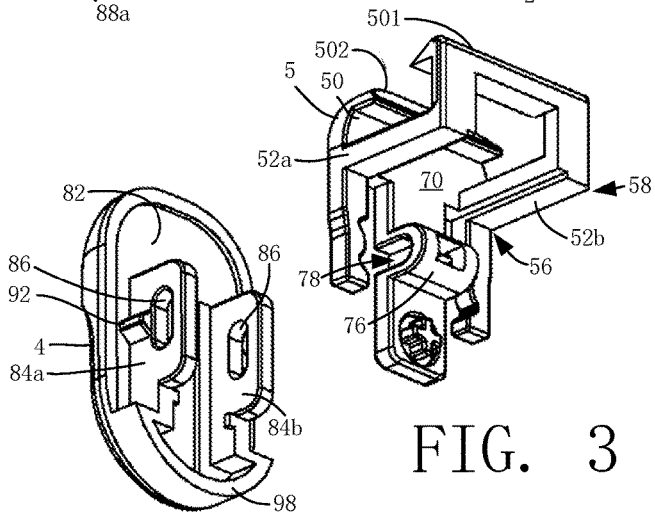
FIG. 3
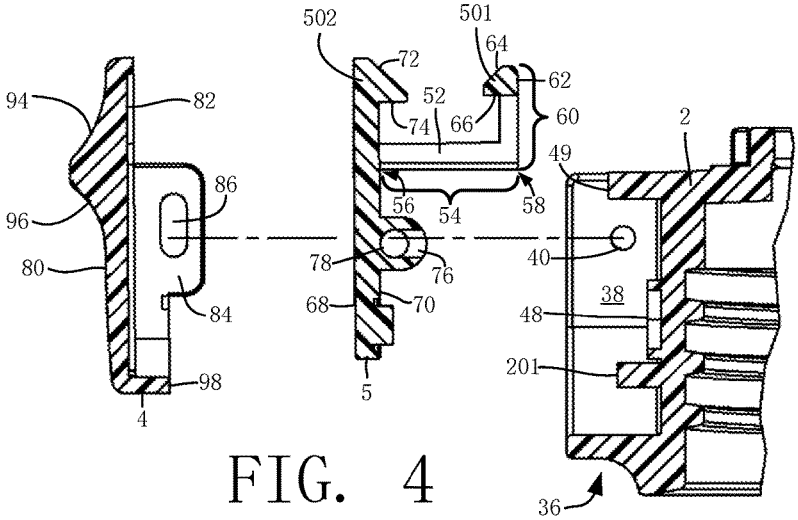
FIG. 4

CUP LID WITH LOCKING AND DELAYED RELEASE

CROSS-REFERENCE TO RELATED APPLICATIONS

This application claims priority to Chinese Invention Patent Application No. 202022488459.4 entitled "A thermal insulation cup lid with locking and delayed popping function that can be operated with one hand" filed before China's National Intellectual Property Administration on Nov. 2, 2020, the entire content of which is incorporated herein by reference.

STATEMENT RE: FEDERALLY SPONSORED RESEARCH/DEVELOPMENT

Not Applicable

BACKGROUND

1. Technical Field

The present disclosure relates generally to a lid for cup, and more specifically to a lid for a thermally insulating tumbler or mug for drinking water or other beverage and includes a locking and delayed release mechanism for operation with one hand.

2. Related Art

Whether to keep a cold liquid cold or a warm liquid warm for extended durations, insulating vessels are widely used. Such vessels, also known as vacuum flasks, are typically comprised of an outer flask and an inner flask disposed within the outer flask and separated by a vacuum that reduces heat transfer. Thermally insulating mugs/tumblers are often used to conveniently store hot beverages such as tea or coffee, as well as cold beverages such as water or juice. Regardless of the temperature of the beverage, easy access thereto is needed. While an open top provides the greatest access, heat loss (in the case of warm beverages) or warming (in the case of cool beverages) is unacceptable. Accordingly, many different stoppers, lids, caps, and other vessel closures have been developed, with the design objective being reduced thermal transfer into and out of the interior of the vessel, ease of opening, and ease of closing, among other considerations.

One such closure mechanism is a pushbutton release lid, in which one side of the lid is in a hinged relationship to a base portion that is threaded onto the open rim of the vessel. The lid incorporates a spring/biasing element and a latch, and upon releasing the latch, the lid is flipped open from the opposite side due to the force of the spring. These lids may also be referred to more generally as automatic release lids.

When storing hot beverages, steam tends to build at the upper portions of the vessel. The action of opening a conventional automatic release lid tends to be abrupt and immediate. Thus, the steam may be immediately released. In some variations of an automatic release lid, there may be a sliding lock that engages with the latch to prevent its movement. Upon unlocking, the separate push button is used to release the latch and open the lid. Thus, opening such lid is understood to be a two-step process, in which the sliding lock is moved, then the button coupled to the latch is pressed and released. Closing the lid and ensuring against inadvertent latch release similarly involves two steps—closing the lid and engaging the same to the latch, then sliding the lock back to the locked position. Since the latch release button and the sliding lock is separated, it may not be possible to open the cup lid with one hand in a single fluid motion. The lock is released in a first motion, and then the finger is moved to the latch release button and pressed in a second motion. Locating the latch release button after sliding the lock may also present a challenge unto itself. Such conventional lids may be difficult to use when driving and in other situations where only one-handed operation is possible, especially with no or limited visual feedback.

Accordingly, there is a need in the art for an improved cup lid with a locking and delayed release.

BRIEF SUMMARY

In order to overcome the existing limitations in the art, the present disclosure proposes a single-handed operation cup lid with locking and delayed release. The described cup lid may include a lockable button with buffered or delayed opening features. By holding the cup in one hand, the user can easily slide the button to an unlocked state, press the button in, and open a narrow gap between the lid and the lid base. The lid can be fully opened when the button is thereafter released.

In accordance with the various embodiments of the disclosure, there may be a lid operable with one hand and include a locking and delayed release. The lid may include a lid base that is coupled to a vessel, with the lid base including a hinge coupled to a lid. One side of the lid base includes a slidable button movable up and down between a locked position and an unlocked position. Additionally there may be a rocker latch with an inner lock hook and an outer lock hook. The lid includes a fixed catch likewise with a catch inner hook and a catch outer hook that are correspondingly engageable to the inner lock hook and the outer lock hook.

Further, the lid base may be equipped with water nozzle which is convenient for drinking.

Further, the lid base may include a liquid outlet and an air vent.

There may be a biasing element between the lid and the lid base, and such biasing element may be a torsion spring or a compression spring.

It is contemplated that the lid of the present disclosure allows opening and unlocking with one hand. Moreover, the lid can be partially opened to release the steam in the vessel, and then fully open. This may be desirable to prevent the expansion of vapor caused by the high temperature of the liquid stored in the vessel. The button can be pressed and held pressed to open the lid slightly and discharge the gas and vapor. Upon releasing the button, the lid can be fully opened to prevent liquid droplets rom splashing. The button can be locked and unlocked by sliding the same up and down with one finger. When opening, the lid can be partly opened and fully opened by pressing the button directly without moving the finger, which improves convenience during use. The lid may be easily operated with one hand, with a single finger controlling the locking and lid release functions to smoothly complete the opening of the lid.

The present disclosure will be best understood accompanying by reference to the following detailed description when read in conjunction with the drawings.

BRIEF DESCRIPTION OF THE DRAWINGS

These and other features and advantages of the various embodiments disclosed herein will be better understood with respect to the following description and drawings, in which like numbers refer to like parts throughout, and in which:

FIG. 2 is a detailed exploded front perspective view of a locking and release assembly in accordance with an embodiment of the present disclosure;

FIG. 3 is a detailed exploded rear perspective view of a button and a latch of the locking and release assembly;

FIG. 4 is an exploded cross-sectional view of the locking and release assembly taken along axis A-A of FIG. 2;

DETAILED DESCRIPTION

Figure 1:
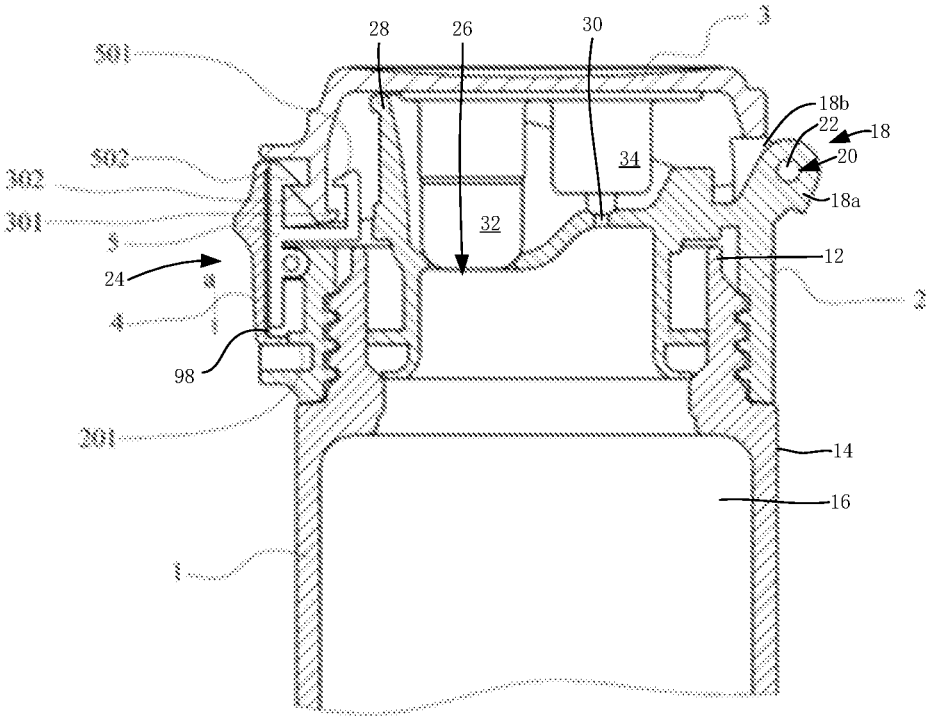
FIG. 1 is a cross-sectional view of an embodiment of a lid according to the present disclosure with the lid being closed and a latch release button in a locked state.

The detailed description set forth below in connection with the appended drawings is intended as a description of the several presently contemplated embodiments of a lid with locking and delayed release, and is not intended to represent the only form in which such embodiments may be developed or utilized. The description sets forth the functions and features in connection with the illustrated embodiments. It is to be understood, however, that the same or equivalent functions may be accomplished by different embodiments that are also intended to be encompassed within the scope of the present disclosure. It is further understood that the use of relational terms such as first and second, top and bottom, left and right and the like are used solely to distinguish one from another entity without necessarily requiring or implying any actual such relationship or order between such entities.

With reference now to the figures, the various features of a lid with locking and delayed release that can be operated with a single hand will be described. As shown therein, a lid assembly 10 includes a lid base 2 that is threadably coupled onto a cylindrical rim portion 12 of a vessel 1. In an exemplary embodiment, the vessel 1 may be a thermally insulating tumbler or cup defined by a cylindrical exterior 14 and an interior 16 that retains a liquid beverage, e.g., drinking water, coffee, tea, etc., though this is by way of example only and not of limitation. That is, the vessel 1 can be a stainless steel thermos cup, a glass cup, a plastic cup and even other non-insulation cups. Along these lines, any other suitable shape or configuration of the vessel 1 may be substituted without departing from the scope of the present disclosure.

The lid assembly 10 further includes a releasable lid 3 that is hindgedly coupled to the lid base 2 via a hinge assembly 18 including a lid base knuckle 18*a* and a lid knuckle 18*b* each defining a pin bore 20 through which a pin 22 is inserted. The pin 22 is understood to be coupled to the lid base knuckle 18*a* and the lid knuckle 18*b*, thereby allowing one to rotate about the other. A torsion spring (not shown) may be located within the pin bore 20 and around the pin 22, with opposing arms of the torsion spring being engaged to a respective one of the lid base 2 and the lid 3 to apply a biasing force against the other, such that when the lid 3 is released, it quickly rotates about the hinge assembly 18 and flips open to reveal an opening channel 26 through which liquid held within the interior 16 of the vessel 1 may flow.

The torsion spring may be substituted with any other suitable type of biasing element, and may be more generally referred to as a hinge return spring. Energy accumulated in the return spring under compression may be released when the constraint can be released. A hinge return spring in the form of the aforementioned torsion spring as set forth above stores energy when the hinge is twisted in one direction, and releases energy in the opposite direction when the constraint is released. In the limited space of the lid 3 and the lid base 2, the use of a tension spring may not be optimal, though a compression spring may be used. Such compression spring may be a coil spring or a strip of flexible sheet metal.

The lid base 2 may define a spout 28 that is generally in fluid communication with the opening channel 26. In an exemplary embodiment, the spout 28 may have a half scoop-shaped nozzle that is fitted for a human mouth and allow the user to drink smoothly and with comfort. The mouth of the opening channel 26 (and hence the spout 28) may be configured to be as large as the mouth of the vessel 1, though in order to avoid excessive liquid flow, the opening channel 26 may be configured to be smaller. For ensuring cleanliness of the liquid retained in the vessel 1, the opening channel 26 may be reduced in size so as to prevent dust and foreign objects in the atmosphere from entering the same, thereby polluting the liquid or beverage in the vessel 1 during use.

In order to facilitate flow and allow for smooth displacement of water when the liquid is flowing across the entire diameter of the opening channel 26, the top of the lid base 2 may further incorporate a relief port 30. The lid base 2 may be constructed of plastic or other non-metallic materials and may incorporate seals at the interfaces between the lid base 2 and the vessel 1 to prevent liquid from seeping out therefrom.

The lid 3 incorporates a main stopper plug 32 that extends from an interior face thereof. The main stopper plug 32 is understood to close off the opening channel 26 defined by the lid base 2 and prevent the outflow of liquid from the interior of the vessel 1. Thus, regardless of the position or orientation in which the vessel 1 is held, the liquid is not contemplated to leak. The lid 3 may also incorporate a relief port stopper plug 34 which similarly closes off the relief port 30 defined on the lid base 2. The main stopper plug 32 and the relief port stopper plug 34 may be of a unitary construction, though this is by way of example only and not of limitation. According to one embodiment, the main stopper plug 32 and the relief port stopper plug 34 may be constructed of a suitably elastic material that can seal off the opening channel 26 and the relief port 30. By way of example, this may be rubber, silicone, or other elastic material that can achieve a seal. The main stopper plug 32 and the relief port stopper plug 34 may have a shape that is slightly oversized relative to the opening channel 26 and the relief port 30. The lid 3 may be constructed of plastic or other nonmetallic materials.

The present disclosure contemplates the lid assembly 10 with the locking and release assembly 24 that can be selectively locked to prevent or allow the lid 3 to be unlatched from the lid base 2 following actuation and release. The locking and release assembly 24 may be disposed on the slide of the lid assembly 10 that is opposite the hinge assembly 18. With additional reference to FIGS. 2-4, the locking and release assembly 24 includes a button 4, a rocker latch 5 in engagement with the button 4, and a receiver 36 to which the button 4 and the rocker latch 5 are mounted.

The receiver 36 defined on the lid base 2 is generally characterized by a raised wall 38 with a first vertical sidewall portion 38*a*, a vertical sidewall portion 38*b* opposite thereto, and a partially circular sidewall portion 38*c* connecting the vertical sidewall portions 38*a*, 38*b*. Defined in each of the vertical sidewall portions 38*a*, 38*b*, are journal holes 40*a*, 40*b*, respectively, which are receptive to a cross pin 42. The journal holes 40 are understood to be axially aligned with each other, and are perpendicular to the vertical sidewall portions 38*a*, 38*b*. The upper portion of the receiver 36 is open-ended. The outer surface of the lid base 2 enclosed within the raised wall 38 defines an area 44, from a center part of which a locking block 201 extends. The locking block 201 is understood to have a rectangular cuboid shape and extend outwardly from the surface of the lid base 2 to an extent less than the height of the wall 38. The receiver 36 further defines a boss 48 in the central part of the area 44 above the locking block 201, as well as a latch rotation limiter 49 at the upper open end of the area 44. The latch rotation limiter 49 may have a rectangular cuboid shape that extends outwardly from the surface of the lid base similar to the locking block 201.

The locking and release assembly 24 further includes the rocker latch 5, which is defined by an actuation plate 50, a pair of right and left arm extensions 52*a*, 52*b* extending from the actuation plate 50, and an inner locking hook 501 integral with and connecting the arm extensions 52. In further detail, the arm extensions 52 are each defined by a first or horizontal section 54 extending perpendicularly to the actuation plate 50, with a proximal end 56 being connected to the actuation plate 50 and an opposed distal end 58. The arm extensions 52 are also each defined by a second or vertical section 60 that extend perpendicularly from the horizontal section 54 at the distal end 58 thereof. The inner locking hook 501 is defined by a vertical face 62, an opposed tapered face 64, and a flat hook interior face 66. The actuation plate 50 is defined by a button engagement face 68 and an opposed inside surface 70 from which the arm extensions 52 extend. Additionally, an outer locking hook 502 extends from the inside surface 70 of the actuation plate 50 and is defined by a tapered face 72 and a flat hook interior face 74.

The actuation plate 50 further includes a hinge knuckle 76 defining a hollow hinge pin bore 78. The hinge knuckle is understood to be offset from and below the arm extensions 52. The actuation plate 50 may be positioned within the receiver 36 such that the hinge pin bore 78 is in axial alignment with the journal holes 40 on the raised wall 38. Furthermore, with the actuation plate 50 so positioned, the cross pin 42 is understood to be inserted through the hinge pin bore 78. Accordingly, the center of the hinge pin bore 78 is the rotational center of the actuation plate 50, with the inner locking hook 501 and the outer locking hook 502 being selectively engageable to or disengeable from the lid 3 depending on the rotated angle of the actuation plate 50, as will be described in further detail below.

The locking and release assembly 24 also includes the button 4 as mentioned above. The button 4 has an exterior actuation surface 80 and an opposed latch engagement face 82 that abuts against the button engagement face 68 of the rocker latch 5. Additionally, the extending from the latch engagement face 82 are a pair of right and left slide rails 84*a*, 84*b*, each of which define a hinge pin slot 86. The button 4 is likewise understood to be positioned within the receiver 36, with the lateral center of the hinge pin slots 86 being in alignment with the hinge pin bore 78 of the rocker latch 5 and the journal holes 40 of the raised wall 38. Thus, the cross pin 42 may extend through both of the hinge pin slots 86.

The button 4 is understood to be slidable upwards and downwards because of the elongated hinge pin slots 86 despite the cross pin 42 being fixed and stationary. The actuation plate 50 defines a pair of corresponding right and left rail slots 88*a*, 88*b* within which the respective slide rails 84*a*, 84*b* of the button 4 are received. Each of the rail slots 88 defines a first detent groove 90*a* for a locked position for the button 4, and a second detent groove 90*b* for an unlocked position for the button 4. The slide rails 84 each include respective ridges 92, each of which are engageable to a corresponding one of the first detent groove 90*a* and the second detent groove 90*b* on the actuation plate 50.

The engagement of the ridges 92 to the detent grooves 90 is understood to stabilize the position of the button 4 relative to the rocker latch 5 and prevent further movement. Those portions of the actuation plate 50 that define the rail slots 88 may also be described as arms extending from the upper end of the same. Such arms are understood to flex when the ridges 92 is pushed against a given one of the detent grooves 90 to allow the sliding movement of the button 4 once a force sufficient to overcome the retention forces of the arm is applied. The extent of the movement prevented may vary depending on the retention forces of the arms, which may correspond to the material rigidity characteristics and/or the thickness thereof. The amount of force necessary to slide the button 4 may preferably be set to be greater than such forces encountered during a typical inadvertent contact. In other words, the force necessary to disengage the ridges 92 from the detent grooves 90 may be at a level corresponding to a deliberate action by the user. After the ridges 92 overcome the retention forces from the arms and settle into the adjacent detent grooves 90, there may be a tactile feedback in the form of a click. In order to facilitate the sliding of the button 4, the exterior actuation surface 80 of the button 4 is defined by an upper fillet 94 that may be pressed to apply downward force against the button 4, and by a lower fillet 96 that may be pressed to apply upward force against the button 4.

With the button 4 being engaged to the first detent groove 90*a*, any inward rotational force applied to the lower half of the button 4 is blocked due to the abutting engagement of a button strut 98 against the locking block 201. This is the condition illustrated in FIG. 1. When shifted downward to the second detent groove 90*b*, the locking block 201 no longer presents an impediment to any rotation force applied to the low half of the button 4. This is the condition illustrated in FIG. 5, which allows movement of the rocker latch 5 and specifically the inner locking hook 501 and the outer locking hook 502. The rotational extent of the button 4 and the rocker latch 5 may be restricted by the latch rotation limiter 49 however. So that the button 4 and the rocker latch 5 return to its default position, a torsion spring may be disposed around the cross pin 42 with one arm of the spring being engaged to the rocker latch 5 or the button 4, and the other arm being engaged to the receiver 36.

Figure 5:
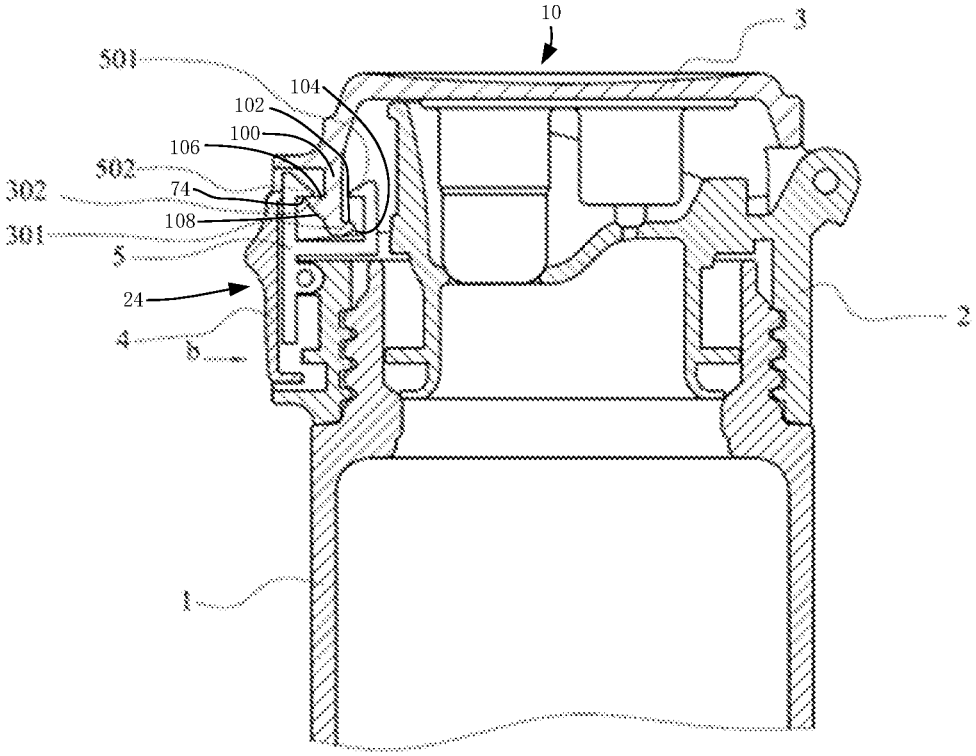
FIG. 5 is a cross-sectional view of the lid in a closed state with the button in an unlocked state.

The button 4 is slidably engaged to the rocker latch 5 and the lid base 2 via the receiver 36. Thus, it is contemplated that the button 4 can be locked and unlocked to prevent or allow the opening of the lid 3. In order to prevent the inadvertent opening, the button 4 may be locked. As discussed above, the button 4 has two positions and may be slid between the same. When in the upper position, the button 4 is in the locked position, and when in the lower position, the button 4 is in the unlocked position. As shown in FIG. 1, the button strut 98 on the lower part of the button 4 is locked by the locking block 201 and cannot be pressed. When the user desires to open the lid 3 to consume the contents of the vessel 1, the button 4 may be shifted downward in the direction a of the arrow. FIG. 5 illustrates the end result of this action, in which the button 4 reaches the lower position.

Opposite the hinge assembly 18, the lid 3 includes a fixed catch 100 that is generally characterized by a catch inner hook 301 and a catch outer hook 302. The catch inner hook 301 is defined by a flat inner latch engagement face 102 and an inner angled face 104, while the catch outer hook 302 is defined by a flat outer latch engagement face 106 and an outer angled face 108. According to the illustrated embodiment, the flat outer latch engagement face 106 is raised relative to the flat inner latch engagement face 102. Furthermore, the inner angled face 104 extends a shorter distance compared to the outer angled face 108.

The lid 3 is retained in a closed position relative to the lid base 2 based upon the abutting engagement of the flat outer latch engagement face 106 and the flat hook interior face 74 of the outer locking hook 502. The biasing element of the lid assembly 10 exerts a constant opposing force against the outer locking hook 502 through the fixed catch 100 of the lid 3, maintaining this abutting engagement between the flat outer latch engagement face 106 and the flat hook interior face 74.

Figure 6:
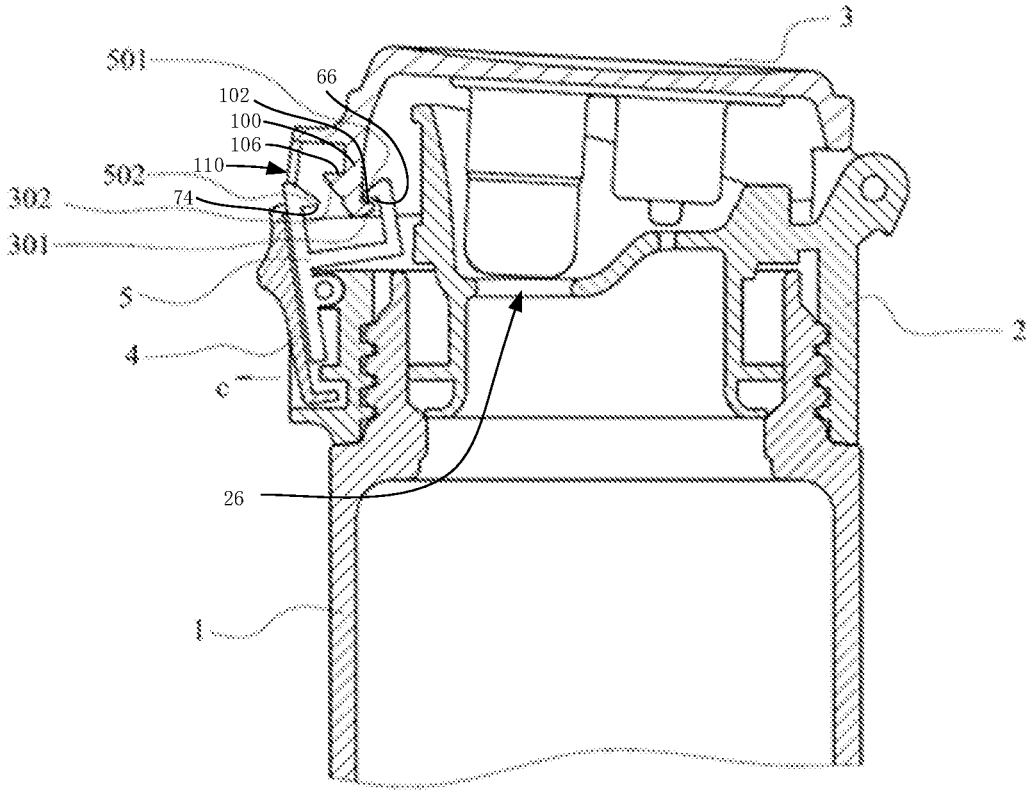
FIG. 6 is a cross-sectional view of the lid in which the button has been pressed and the latch is partly disengaged from the lid to partially open the lid.

The catch inner hook 301 may be disengaged from the outer locking hook 502 upon pressing in the button 4 along the direction indicated by arrow b in FIG. 5 to rotate the rocker latch 5 outwardly away. FIG. 6 illustrates this disengaged state, in which the rocker latch 5 is rotated away from the catch inner hook 301 such that the flat outer latch engagement face 106 and the flat hook interior face 74 are no longer abutting against each other.

The button 4 can remain depressed to maintain the rocker latch 5 at its maximum rotational extent. As the lid 3 begins to rotate upwards (clockwise in the view shown in FIG. 6), the opposite part of the fixed catch 100, that is, the flat inner latch engagement face 102 of the catch inner hook 301, comes into an abutting engagement with the flat hook interior face 66 of the inner locking hook 501 to stop the rotating/flipping movement of the lid 3. The aforementioned biasing element of the lid assembly 10 exerts a constant opposing force against the inner locking hook 501 through the fixed catch 100 of the lid 3, thus maintaining the abutting engagement between the flat hook interior face 66 and the flat inner latch engagement face 102.

Again, the rocker latch 5 can serve to retain the lid 3 to the lid base 2 in a tightly coupled relationship, and sealing the opening channel 26 to prevent the liquid stored within the vessel 1 from leaking/flowing out. As described above, the rocker latch 5 may effectively buffer the initial opening of the lid 3, with the partially opened stated shown in FIG. 6 being maintained so long as the button 4 is pressed in and the rocker latch 5 is in engagement with the fixed catch 100 of the lid 3. The partially opened state effects a delayed opening or buffering, as well as allow for the partial dispersion of steam or accumulated gas from the interior of the vessel 1 through the limited gap 110.

Figure 7:
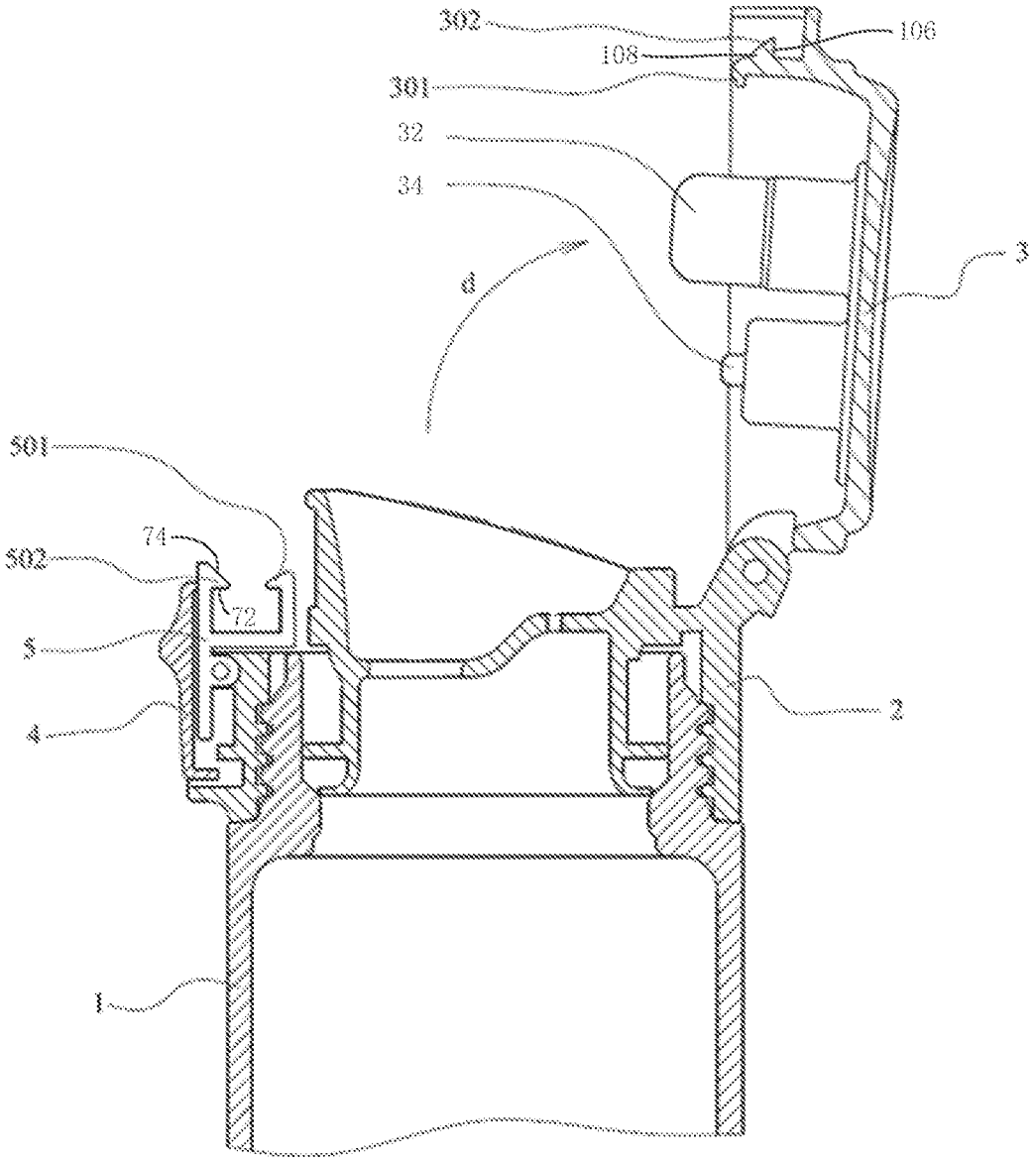
FIG. 7 is a cross-sectional view of the lid in which the latch is disengaged from the lid to release and fully open the lid.

Once the button 4 is released as illustrated in FIG. 7, the biasing element/torsion spring of the locking and release assembly 24 returns the button 4 and the rocker latch 5 to its vertical position. In other words, the rocker latch 5 is reset under the action of the biasing element in the direction indicated by arrow c. Additionally, the inner locking hook 501 is disengaged from the fixed catch 100 of the lid 3, and the flat inner latch engagement face 102 is no longer in an abutting relationship to the flat hook interior face 66. As shown in FIG. 7, with no other element blocking the rotation of the lid 3, the biasing element of the lid assembly 10 forces the rotation of the lid to its maximum extent in the direction of arrow d.

Closing the lid 3 is contemplated to be possible without additional manipulation of the button 4. Rather, with the rocker latch 5 and the button 4 being returned to is default vertical position, the outer locking hook 502 is within the rotation path of the catch outer hook 302. The lid 3 can be closed and pushed on to the rocker latch 5. In further detail, both the tapered face 702 of the outer locking hook 502 and the outer angled face 108 of the catch outer hook 302 provide a gradual, sliding engagement of the two faces, with the rocker latch 5 being rotated counterclockwise (relative to the view shown in FIG. 7) to give way to the travel of the fixed catch 100. An edge portion between the apex and the outer angled face 108 may also be rounded to further smooth the transition during this movement. The biasing element of the locking and release assembly 24 returns the rocker latch 5 to its vertical position in which the flat hook interior face 74 is in an abutting engagement with the flat outer latch engagement face 106 of the fixed catch 100.

In accordance with various embodiments of the present disclosure, a series of actions can be performed by holding the cup or vessel 1 with one hand. The user may slide down the button 4 to unlock, press in the button 4 to open the gap 110 in the opening part of the lid 3, and then release the button 4 to fully open the lid, that is, complete opening with one hand. Opening the gap 110 between the lid 3 and the lid base 2 is understood to prevent the release of water vapor from hot water or other beverages stored in the vessel 1. The button 4 may be pressed in during the first actuation to slightly discharge the accumulated gas/steam. This may be maintained for any desirable time duration, and releasing the button 4 fully opens the lid 3. The drinking port that is the opening channel 26, may be designed to fit the normal mouth shape of the human body, and allow smoother flow of the beverage. The various seals discussed above can render the vessel 1 watertight, though they can be easily removed for cleaning to improve hygiene. Regardless of usage settings, whether at home, the office, driving/riding in a car, or operating machinery or equipment, the user can unlock and open the lid 3 using one hand to enjoy the beverage.

The particulars shown herein are by way of example and for purposes of illustrative discussion of the embodiments of the lid with locking and delayed release. The specifics described above, such as the shape of the button, the shape of the latch and a cup shape, etc. are exemplary only, and modifications or equivalent replacements are understood to be within the purview of those having ordinary skill in the art, and does not require departing from the spirit and scope of the present disclosure. Rather, these and other features of the disclosure are presented in the cause of providing what is believed to be the most useful and readily understood description of the principles and conceptual aspects. In this regard, no attempt is made to show details with more particularity than is necessary, the description taken with the drawings making apparent to those skilled in the art how the several forms of the present disclosure may be embodied in practice.

What is claimed is:

1. A lid for a liquid-retaining and dispensing vessel, comprising:

a lid base coupled to the vessel;

a lid hingedly coupled to the lid base and including a fixed catch defined by a catch inner hook and a catch outer hook; and a locking and release assembly selectively coupling the lid to the lid base, the locking and release assembly including a receiver with a locking block, a rocker latch defined by an inner locking hook and an outer locking hook facing each other in a horizontally opposing relationship and a button in sliding engagement with the rocker latch with a button strut being obstructed by the locking block in a first, locked position of the button relative to the rocker latch, the inner locking hook of the rocker latch being engaged to the catch inner hook of the fixed catch with the lid being partially closed relative to the lid base, and the outer locking hook being engageable to the catch outer hook.

2. The lid of claim 1, wherein the outer locking hook of the rocker latch is engaged to the catch outer hook of the fixed catch with the lid being fully closed relative to the lid base.

3. The lid of claim 1, wherein the rocker latch includes an actuation plate with arm extensions projecting therefrom.

4. The lid of claim 3, wherein the outer locking hook extends from the actuation plate.

5. The lid of claim 3, wherein the arm extensions are each defined by a horizontal section and a vertical section, the inner locking hook being integral with the vertical section.

6. The lid of claim 3, wherein the actuation plate defines a hinge knuckle with a hinge pin bore coaxial with corresponding journal holes defined on the receiver.

7. The lid of claim 3, wherein:

the button includes a pair of opposed slide rails each with a detent ridge; and the actuation plate defines a pair of opposed rail slots receptive to the slide rails of the button.

8. The lid of claim 7, wherein the rail slots each define a first detent groove corresponding to the first, locked position of the button with the detent ridges of the slide rails engaged thereto, and a second detent groove corresponding to the second, unlocked position of the button with the detent ridges of the slide rails engaged thereto.

9. The lid of claim 7, wherein the slide rails of the button each define a hinge pin slot in alignment with corresponding journal holes defined on the receiver.

10. The lid of claim 1, wherein the lid base includes a spout.

11. The lid of claim 1, wherein the lid base includes a pressure relief port.

12. A locking and release assembly for selectively coupling a lid to a lid base, comprising:

a receiver with a pair of opposed sidewalls each defining a journal hole and a locking block;

a rocker latch with an inner locking hook and an outer locking hook, the outer locking hook being disengeable from a corresponding catch outer hook on the lid while maintaining engagement between the inner locking hook and a corresponding catch inner hook on the lid, a gap separating the lid from the lid base, the rocker latch including a hinge knuckle defining a hinge pin bore;

a button in sliding engagement with the rocker latch, the button defining a strut selectively positionable to be obstructed by the locking block to prevent rotational movement of the rocker latch, the button further including a pair of opposed slide rails each defining hinge pin slots aligned with the hinge pin bore and the journal holes; and a hinge pin extending through the journal holes, the hinge pin slots of the button, the hinge pin bore of the rocker latch.

13. The locking and release assembly of claim 12, wherein the rocker latch includes an actuation plate with arm extensions projecting therefrom.

14. The locking and release assembly of claim 13, wherein the outer locking hook extends from the actuation plate.

15. The locking and release assembly of claim 13 wherein the arm extensions are each defined by a horizontal section and a vertical section, the inner locking hook being integral with the vertical section.

16. The locking and release assembly of claim 13 wherein each of the slide rails define a detent ridge.

17. The locking and release assembly of claim 16, wherein the rail slots each define a first detent groove corresponding to the first, locked position of the button with the detent ridges of the slide rails engaged thereto, and a second detent groove corresponding to the second, unlocked position of the button with the detent ridges of the slide rails engaged thereto.

18. The locking and release assembly of claim 17, wherein the slide rails of the button each define a hinge pin slot in alignment with corresponding journal holes defined on the receiver.

19. The locking and release assembly of claim 12, wherein the button is defined by an upper fillet and a lower fillet.

* * * * *